United States Patent [19]

Turlak et al.

[11] Patent Number: 4,460,150

[45] Date of Patent: Jul. 17, 1984

[54] ANNULAR BLOWOUT PREVENTER

[75] Inventors: Robert J. Turlak; Bolie C. Williams, III; Gary R. Schaeper, all of Houston, Tex.

[73] Assignee: Cameron Iron Works, Inc., Houston, Tex.

[21] Appl. No.: 335,219

[22] Filed: Dec. 28, 1981

[51] Int. Cl.[3] ..... E21B 33/06

[52] U.S. Cl. ..... 251/1 B; 251/212; 277/235 R

[58] Field of Search ..... 251/1 B, 1 R, 212; 166/82, 84; 277/73, 34, 235 R

[56] References Cited

U.S. PATENT DOCUMENTS

| | | | |
|---|---|---|---|
| 3,915,424 | 10/1975 | LeRouax | 251/1 B |
| 4,256,314 | 3/1981 | Berglund et al. | 277/73 |
| 4,310,139 | 1/1982 | Williams et al. | 251/1 B |

*Primary Examiner*—Martin P. Schwadron
*Assistant Examiner*—Sheri Novack
*Attorney, Agent, or Firm*—Vinson & Elkins

[57] ABSTRACT

An improved annular blowout preventer having a housing, an annular packer mounted in the housing, and a piston mounted in the housing for the application of an axial force to the annular packer; the annular packer includes a resilient annulus with a circular series of rigid interengaging inserts embedded in its upper face with the inner ends of the inserts being thicker than the outer ends so that the inner ends of the inserts move inward as the resilient annulus is moved and interengaging side projections and recesses with shoulders to ensure substantially uniform inward movement of the inner ends of the inserts to a preselected inner support position for the resilient annulus.

8 Claims, 6 Drawing Figures

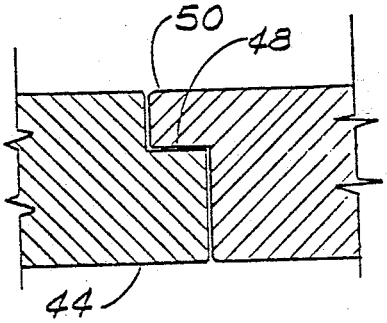
Fig. 4
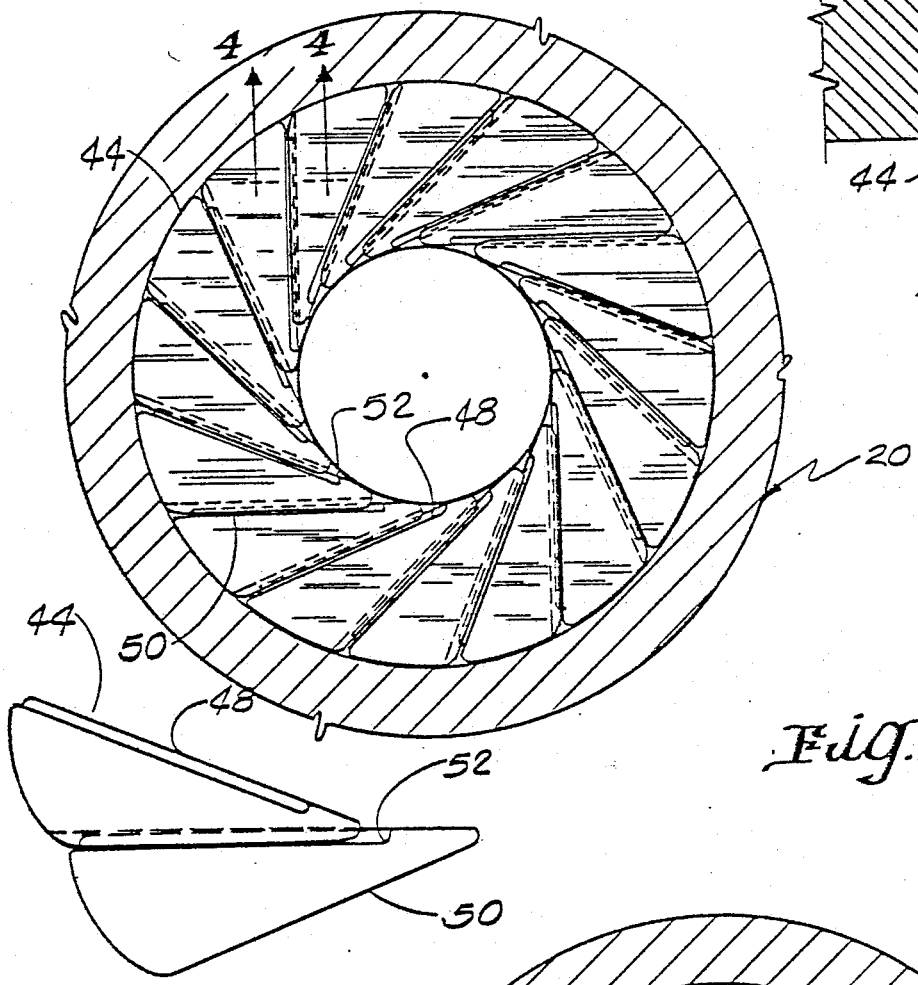
Fig. 2
Fig. 6
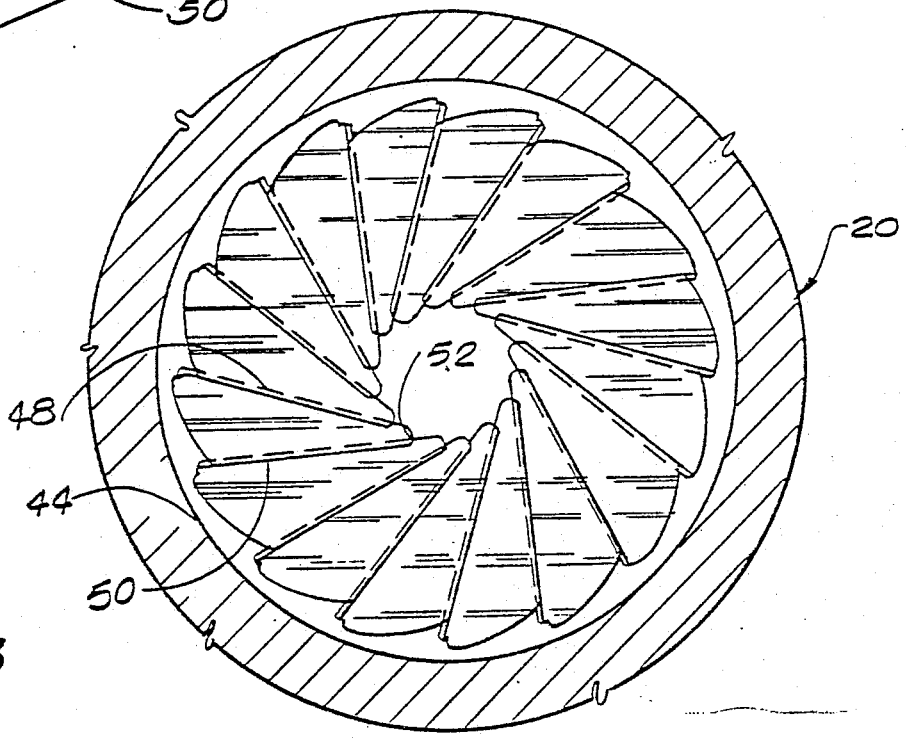
Fig. 3

ANNULAR BLOWOUT PREVENTER

BACKGROUND

Blowout preventers are used to control pressure within oil and gas wells during drilling and completion of the well. Annular blowout preventers, the type to which the present invention relates, include a single annular resilient packing positioned within a body having means to cause the packing to be moved into sealing engagement with a portion of a pipe string extending through the preventer or against itself to seal a well when no pipe string extends through the preventer.

An annular blowout preventer is shown and described in U.S. Pat. No. 3,572,627 to Jones et al. The packer has a resilient annulus with a circular series of rigid inserts extending through the packer and having irising end flanges on both ends which move to provide end support of the resilient annulus when it is compressed radially inward by pistons. These pistons are positioned around the resilient annulus to provide a direct inwardly directed radial force on the resilient annulus. Other annular preventers have utilized and axial deformation of the resilient annulus to cause it to move radially inward to sealing positions. U.S. Pat. Nos. 4,099,699, 2,287,205, 3,667,721, 3,323,773, 2,148,844, 2,812,197 and 2,846,178 are examples of annular blowout preventers of the prior art.

The application of an axial force on the resilient annulus of an annular blowout preventer is simpler and less expensive than the application of a relatively uniform radial force to the resilient annulus. The use of an axial force with the resilient annulus of the above cited Jones et al patent would not be suitable as the rigid inserts would prevent effective axial deformation of the annulus.

It is desired, however, that when such axial force is applied to the resilient annulus that the upper inserts as shown in pending application Ser. No. 06/137,549, filed Apr. 4, 1980 have an irising action to move their inner ends inward to provide support for a portion of the resilient annulus moving inwardly into sealing position.

SUMMARY

The present invention provides an improved annular blowout preventer with an improved annular packer. The preventer includes a housing, an annular packer, and a piston for the application of an axial force to the annular packer. The packer includes a resilient annulus with a circular series of rigid interengaging inserts embedded in its upper face with the inserts tapering upwardly and outwardly, thus, the inner ends of the inserts are thicker than the outer ends so that the inner ends of the inserts move inward as the resilient annulus is moved inward and interengaging side projections and shoulders in the recesses of the inserts ensure substantially uniform inward movement of the inner ends of the inserts to preselected inner positions providing uniform upper support for the resilient annulus. Another circular series of inserts may be embedded in the lower face of the resilient annulus.

An object of the present invention is to provide an improved annular blowout preventer of simple construction and relatively long service life.

Another object is to provide an improved annular packer for an annular blowout preventer having inwardly moving upper support which the resilient annulus is moved inwardly.

A further object is to provide an improved packer which has improved protection from extrusion when closed and holding pressure.

A still further object is to provide an improved annular blowout preventer which can actuate many times to sealed position without incurring such damage as would render it unfit for continued use.

BEIEF DESCRIPTION OF THE DRAWINGS

These and other objects and advantages are hereinafter set forth and explained with reference to the drawings wherein:

FIG. 2 is a top plan view of the packer in its relaxed or open position.

FIG. 3 is a view similar to FIG. 2 with the packer in its closed or sealed position.

FIG. 4 is a partial sectional view taken along line 4—4 in FIG. 2.

FIG. 6 is an enlarged plan view showing two inserts to illustrate their interengagement.

DESCRIPTION OF THE PREFERRED EMBODIMENT

Figure 1:
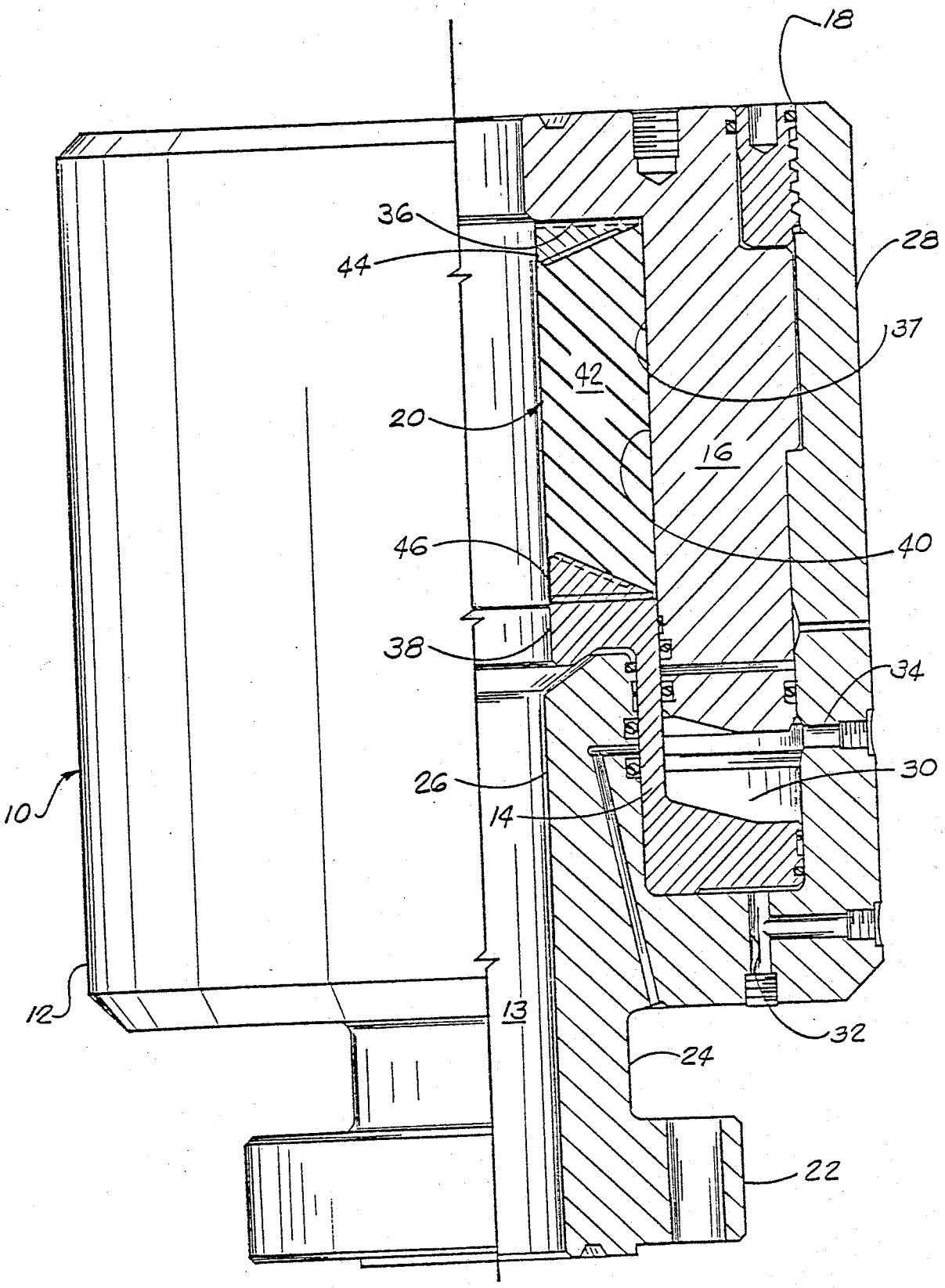
FIG. 1 is a view partly in elevation and partly in section of the preferred form of the improved annular blowout preventer of the present invention with its packer in relaxed or open position.
Figure 5:
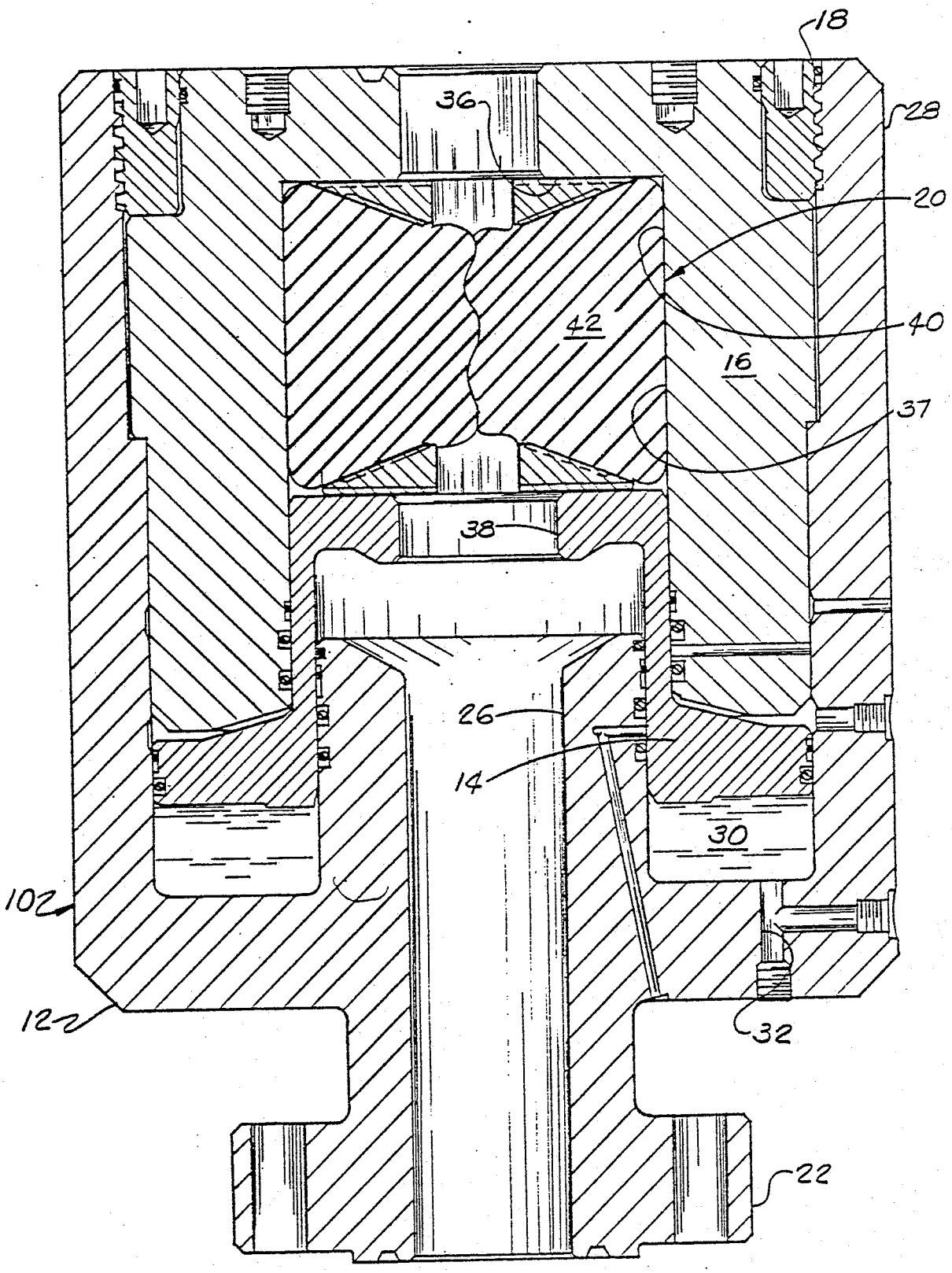
FIG. 5 is a view similar to FIG. 1 but showing the preventer packer in closed or sealed position.

Improved annular blowout preventer 10 as shown in FIGS. 1 and 5 includes annular housing 12 with the vertical bore 13 therethrough, annular piston 14, retainer ring 16, lock ring 18 and packer 20. Housing 12 includes lower flange 22 connected to neck 24, annular rim 26 extending upwardly from neck 24 and exterior annular housing section 28 which extends radially outward from neck 24 and upwardly around and spaced from rim 26. Chamber 30 is the annular space between rim 26 and section 28 below the lower end of retainer ring 16. Piston 14 is movably positioned partially within chamber 30 as shown. Passage 32 extends through housing section 28 into chamber 30 to deliver fluid under pressure to the lower side of piston 14 causing it to move upward and to exhaust fluids as piston 14 moves downward. Passage 34 extends through housing section 28 into chamber 30 to deliver fluid under pressure to the upper side of piston 14 causing it to move downward and to exhaust fluids as piston 14 moves upward.

Packer 20 is annular in shape, as hereinafter described, is positioned within recess 37 between shoulder 36 of retainer ring 16, and the upper end of annular arm 38 on piston 14. Packer 20 is engaged on its lower end by annular arm 38 of piston 14. Thus, as piston 14 moves upward, its arm 38 exerts an axial force on packer 20. Shoulder 36 prevents upward movement of packer 20 and inner surface 40 of retainer ring 16 prevents radial outward movement of packer 20 whereby the packer is moved to its closed or sealed position as shown in FIG. 2.

Packer 20 is illustrated in greater detail in FIGS. 2, 3, 4 and 6 and includes resilient annulus 42, an upper circular series of rigid inserts 44 arranged on, bonded to, and embedded in the upper surface of annulus 42 and a lower circular series of rigid inserts 46 bonded to the lower surface of and embedded in annulus 42. Rigid inserts 44 are triangular shaped in plan and taper upwardly and outwardly so that the inner ends are thicker than the outer ends. The inner ends of inserts 44 are sufficiently long to ensure that they are moved inwardly with the movement of annulus 42 and to ensure that they are pivoted inwardly as shown in FIG. 3. In the relaxed open position of the annulus, as shown in FIG. 2, the triangular shaped inserts 44 are skewed to the axis of the packer and abut each other, so that as the annular piston 14 moves to closed position, as shown in FIG. 3, the inserts 44 are caused to rotate in irising fashion to less skewed positions and to move radially inward. This increases support for the annulus by increasing the effective radial lengths (i.e., radial extents) of the inserts.

Rigid inserts 46 may be the same as inserts 44 or may be substantially the same as inserts 44 except that they may be the reverse of inserts 44 so that they have the same relative movement as inserts 44. It is believed that using rigid inserts 46 which are identical to inserts 44 may be advantageous. When actuated the opposite rotation of inserts 46 from inserts 44 will impart a slight twist to annulus 42. This twisting of annulus 42 is believed to assist annulus 42 in opening.

As discussed, the movement of resilient annulus 42 when axially deformed causes a pivoting movement of inserts 44 to provide the support for the upper end of resilient annulus 42. This movement of bodies 48 can be termed an irising action since it does cause a reduction in the diameter of the effective support by inserts 44. Inserts 46 have a similar irising action.

Each of inserts 44 has a recess 48 along one side and a projection 50 along their other side. The recess 48 terminates short of the inner end of inserts 44 to provide shoulder 52, which is engaged by the inner end of the adjacent project 50 when one of the inserts projects further inward than its adjacent insert. In this way, there is provided a means of uniformly supporting the upper portion of the resilient annulus 42 when it is closed on a pipe or on itself.

During normal well operations piston 14 is in its lower position and packer 20 is relaxed providing a full bore 62 which is at least as large as bore 13 as shown in FIG. 1. When it is desired that preventer 10 be closed, fluid under pressure is supplied through passage 32 into chamber 30 and passage 34 is connected to a suitable exhaust (not shown). This causes piston 14 to move upward so that arm 38 axially deforms packer 20. This deformation moves annulus 42 inwardly as shown in FIG. 5. Also, inserts 44 and 46 pivot and move radially inward to the position shown in FIG. 3 to increase the support of the central portion of annulus 42. Relaxation of annulus 42 is provided by relieving the fluid pressure under piston 14 through passage 32 and applying fluid pressure above piston 14 through passage 34. This causes piston 14 to move to the position shown in FIG. 1 and allows packer 20 to return to its full open position.

As shown, the inner end of each projection 50 engages shoulder 52 at the end of adjacent recess 48 to ensure a generally circular position of the inner ends of inserts 44 and 46 when packer 20 is closed.

What is claimed is:

1. An annular blowout preventer comprising an annular housing having an axially extending annular chamber therein and ports extending through said housing into opposite ends of the chamber, means providing an inwardly projecting, downwardly facing shoulder within said housing, an annular packer on the interior of said housing with one end against said shoulder, and annular piston in said chamber and having an arm engaging the end of the packing opposite to the end engaging the shoulder, alternate application of pressure to opposite ends of said chamber moving said piston against said packing to deform it between the piston and said shoulder into an inner sealing position and away from the shoulder to allow said packer to relax to its open position, said packer comprising a resilient deformable annulus having an inner periphery, and a plurality of irising inserts embedded in the upper end of the resilient body and having a lower surface which is continuously tapered upwardly and outwardly so that their inner ends have increased thickness which extend partially along the length of the annulus on its inner peripheral surface a distance substantially less than the axial length of the annulus when fully deformed, each insert being generally triangular shaped in plan view, skewed to the axis of the packer and in abutment with each other, said resilient annulus engaging the tapered surfaces of said inserts to move said inserts inwardly at their inner ends in a pivoting movement with their outer edge remaining near the outer edge of said resilient annulus.

2. An annular blowout preventer according to claim 1 including means providing interengagement between adjacent inserts for uniformly moving the inner ends thereof into a preselected supporting position when said annulus is deformed.

3. An annular blowout preventer comprising an annular housing having an axially extending annular chamber therein and ports extending through said housing into opposite ends of the chamber, means providing an inwardly projecting, downwardly facing shoulder within said housing, an annular packer on the interior of said housing with one end against said shoulder, and an annular piston in said chamber and having an arm engaging the end of the packing opposite to the end engaging the shoulder, alternate application of pressure to opposite ends of said chamber moving said piston against said packing deform it between the piston and said shoulder into an inner sealing position and away from the shoulder to allow said packer to relax to its open position, said packer comprising a resilient deformable annulus having an inner periphery, and a plurality of irising inserts embedded in the upper end of the resilient body and tapering upwardly and outwardly so that their inner ends have increased thickness which extend partially along the length of the annulus on its inner peripheral surface a distance substantially less than the axial length of the annulus when fully deformed each of said inserts including a recess extending along one side thereof and terminating in a shoulder spaced from end thereof, and a projection extending along the other side thereof, the projections being positioned in the recess of the adjacent insert and engageable with said shoulder of the adjacent insert at the inner end of the recess to provide uniform movement of said inserts to a preselected inner position supporting said packer.

4. An annular blowout preventer comprising an annular housing having an axially extending annular chamber therein, and ports extending through said housing into opposite ends of the chamber, means providing an inwardly projecting downwardly facing shoulder within said housing, an annular packer within said housing with one end against said shoulder, an annular piston in said chamber and having an arm engaging the end of the packing opposite to the end engaging the shoulder, alternate application of pressure to opposite ends of said chamber moving said piston against said packing to squeeze it between the piston and said shoulder into an inner sealing position and away from the shoulder to allow said packer to relax to its open position, said packer comprising a resilient annulus having an inner periphery, and a substantially circular series of rigid inserts which are responsive to movement of said resilient annulus and which are arranged on one end of the resilient annulus with their upper surfaces generally perpendicular to the inner periphery of said annulus and their radially innermost ends substantially adjacent said inner periphery, when the resilient annulus is unconstricted and being generally triangular shaped in plan view, skewed to the packer axis and in abutment with each other and having their lower surfaces continuously tapered from their inner ends to their outer ends so that their innermost ends are substantially thicker than their outermost ends to cause them to pivot with their inner ends moving inwardly as the resilient annulus is constricted, the tapered lower surfaces of said inserts coacting with said resilient annulus to cause the pivotal movement of said inserts.

5. An annular blowout preventer comprising housing with a vertical bore therethrough and having an annular chamber, means providing an inner shoulder facing in the direction of the annular chamber within said housing, an annular resilient packer positioned against said shoulder, an annular piston positioned in said chamber and having an arm extending from said chamber to engage the end of said packer away from said shoulder, means for delivering and exhausting fluids under pressure from opposite sides of said piston within said chamber to cause axial movement of said piston, said packer including a resilient annulus having an inner portion and an outer position, and a substantially circular series of irising inserts embedded in the upper end of said annulus, skewed to the packer axis and in abutment with each other, said inserts being triangular shaped in plan view and having their lower surface continuously tapered so that their innermost ends are substantially thicker than their outermost ends and extending in the inner portion of the annulus a sufficient distance, so that the inserts are moved inwardly in an irising action with the inward movement of the resilient annulus, and terminating a sufficient distance from the opposite end of said annulus, to ensure that a sufficient amount of said annulus is available for sealing responsive to its axial deformation, the taper of the under surface of said inserts coacting with said resilient annulus to cause the pivotal movement of said inserts.

6. A packer for use in an annular blowout preventer having means for axially compressing the packer comprising a resilient deformable annulus having an inner periphery, and a plurality of irising inserts embedded in the upper end of the resilient body and including inner ends of increased thickness extending partially along the lengths of the annulus on its inner periphery a distance substantially less than the axial length of the annulus when fully deformed, the lower surface of said inserts being continuously tapered so that they coact with said resilient annulus to cause the pivotal movement of said inserts during movement of the resilient annulus.

7. A packer according to claim 6 including means providing interengagement between adjacent inserts for uniformly moving the inner ends thereof into a preselected supporting position when said annulus is deformed.

8. A packer comprising a resilient deformable annulus having an inner periphery, and the resilient body and including inner ends of increased thickness extending partially along the length of the annulus on its inner periphery a distance substantially less than the axial length of the annulus when fully deformed, each of said inserts including a recess extending along one side thereof and terminating in a shoulder spaced from the inner end thereof, and a projection extending along the other side thereof, the projections being positioned in the recess of the adjacent insert and engageable with the shoulder at the inner end of the recess on the adjacent insert when the inner end of one insert moves inward a substantial distance more than the adjacent insert and when said insert move to their inner positions so that the projection-shoulder engagement provides a uniform inward movement of the inserts to a preselected inner annulus support position.

* * * * *

UNITED STATES PATENT AND TRADEMARK OFFICE

CERTIFICATE OF CORRECTION

PATENT NO. : 4,460,150

DATED : July 17, 1984

INVENTOR(S) : Robert J. Turlak,
Bolie C. Willims, III, and Gary R. Schaeper

It is certified that error appears in the above—identified patent and that said Letters Patent is hereby corrected as shown below:

Column 4, lines 5 and 6, change "packing" to -- packer --;

Column 4, line 44, change "packing" to -- packer --;

Column 4, lines 47 and 48, change "packing" to -- packer --;

Column 4, line 56, change "body" to -- annulus --;

Column 4, line 61, after "deformed", insert a comma (,);

Column 4, line 64, after "from", insert -- the inner --;

Column 5, line 12, change "packing" to -- packer --;

Column 5, lines 15 and 16, change "packing" to -- packer --;

Column 5, line 59 change "position" to -- portion --;

Column 6, line 23, change "body" to -- annulus --;

Rewrite Claim 8 as follows:

8. A packer for use in an annular blowout preventer having means for axially compressing the packer comprising a resilient deformable annulus having an inner periphery, and a plurality of irising inserts embedded in the upper end of the resilient annulus and including inner ends of increased thickness extending partially along the length of the annulus on its inner periphery a distance substantially less than the axial length of the annulus when fully deformed, comprising

UNITED STATES PATENT AND TRADEMARK OFFICE

CERTIFICATE OF CORRECTION

PATENT NO. : 4,460,150

DATED : July 17, 1984

INVENTOR(S) : Robert J. Turlak,
Bolie C. Willims, III, and Gary R. Schaeper

It is certified that error appears in the above—identified patent and that said Letters Patent is hereby corrected as shown below:

a resilient deformable annulus having an inner periphery, and the resilient body and including inner ends of increased thickness extending partially along the length of the annulus on its inner periphery a distance substantially less than the axial length of the annulus when fully deformed, each of said inserts including a recess extending along one side thereof and terminating in a shoulder spaced from the inner end thereof, and a projection extending along the other side thereof, the projections being positioned in the recess (48) of the adjacent insert and engageable with the shoulder at the inner end of the recess on the adjacent insert when the inner end of one insert moves inward a substantial distance more than the adjacent insert and when said inserts move to their inner positions so that the projection-shoulder engagement provides a uniform inward movement of the inserts to a preselected inner annulus support position.

Signed and Sealed this

*Twenty-eighth* Day of *January 1986*

[SEAL]

*Attest:*

DONALD J. QUIGG

*Attesting Officer*

*Commissioner of Patents and Trademarks*